US008083546B2

(12) United States Patent
Lee

(10) Patent No.: US 8,083,546 B2
(45) Date of Patent: Dec. 27, 2011

(54) ELECTRIC CONNECTOR AND ELECTRIC ASSEMBLY

(75) Inventor: Sheng-Yuan Lee, Taipei Hsien (TW)

(73) Assignee: VIA Technologies, Inc., New Taipei (TW)

( * ) Notice: Subject to any disclaimer, the term of this patent is extended or adjusted under 35 U.S.C. 154(b) by 103 days.

(21) Appl. No.: 12/685,871

(22) Filed: Jan. 12, 2010

(65) Prior Publication Data

US 2011/0021043 A1 Jan. 27, 2011

Related U.S. Application Data

(60) Provisional application No. 61/228,953, filed on Jul. 27, 2009.

(30) Foreign Application Priority Data

Oct. 29, 2009 (TW) ..... 98136684 A

(51) Int. Cl.
*H01R 13/648* (2006.01)

(52) U.S. Cl. ..... 439/607.02; 439/79

(58) Field of Classification Search ..... 439/79, 439/80, 83, 108, 607.2, 607.21, 607.31, 607.35, 439/607.4, 660
See application file for complete search history.

(56) References Cited

U.S. PATENT DOCUMENTS 6,535,264 B1 * 3/2003 Imabayashi et al. ..... 349/155
7,534,141 B1 * 5/2009 Wu ..... 439/607.01
7,540,786 B1 * 6/2009 Koser et al. ..... 439/660
7,682,163 B2 * 3/2010 Hou et al. ..... 439/79
7,686,656 B2 * 3/2010 Zheng et al. ..... 439/660
7,806,735 B1 * 10/2010 Chen et al. ..... 439/676
7,850,465 B1 * 12/2010 Wan et al. ..... 439/79
7,942,704 B2 * 5/2011 Ko et al. ..... 439/660

FOREIGN PATENT DOCUMENTS

CN 101256545 9/2008
CN 101540463 9/2009
CN 201440548 4/2010

OTHER PUBLICATIONS

Chinese First Examination Report of China Application No. 200910207986.9, dated Mar. 15, 2011.

* cited by examiner

*Primary Examiner* — Thanh Tam Le
(74) *Attorney, Agent, or Firm* — J.C. Patents

(57) ABSTRACT

An electric assembly includes a circuit board and an electric connector. The circuit board comprises a first surface and a second surface opposite thereto. The electric connector includes a metallic case, an insulating base, first leads and second leads. The insulating base is connected with the metallic case. The first leads are disposed on the insulating base and soldered to the first surface. The first leads includes a pair of first differential signal leads, a pair of second differential signal leads and a ground lead located between the pair of first differential signal leads and the pair of second differential signal leads. The second leads are disposed on the insulating base and soldered to the second surface. The second leads include a power lead, a second ground lead and a pair of third differential signal leads located between the power lead and the second ground lead.

14 Claims, 5 Drawing Sheets

ELECTRIC CONNECTOR AND ELECTRIC ASSEMBLY

CROSS-REFERENCE TO RELATED APPLICATION

This application claims the priority benefit of U.S. provisional application Ser. No. 61/228,953, filed on Jul. 27, 2009, all disclosures are incorporated therewith. This application also claims the priority of Taiwan application serial no. 98136684, filed on Oct. 29, 2009. The entirety of each of the above-mentioned patent applications is hereby incorporated by reference herein and made a part of this specification.

BACKGROUND OF THE INVENTION

1. Field of the Invention

The present invention is related to an electric connector and an electric assembly applying the same, and more particularly, to an electric connector for a universal serial bus and an electric assembly applying the same.

2. Description of Related Art

Universal Serial Bus 3.0 (USB 3.0) is defined as a new signal transmission specification evolved from USB 2.0 and featured in a high transmission rate raised to 5 G bps, while the transmission rate of USB 2.0 is only 480 M bps. USB 3.0 electric connectors are compatible for USB 2.0 electric connectors, i.e. the USB 3.0 adopts the same connector structure as USB 2.0 with several additional pins for USB 3.0 functions. A new connector structure for USB 3.0 based on the conventional USB 2.0 connector structure is now proposed to meet signal transmission requirements.

SUMMARY OF THE INVENTION

As embodied and broadly described herein, an electric connector suitable for mounted to a circuit board is provided. The circuit board comprises a first surface and a second surface opposite thereto. The electric connector includes a metallic case, an insulating base, a plurality of first leads and a plurality of second leads. The insulating base is connected with the metallic case. The first leads are disposed on the insulating base and soldered to the first surface. The first leads includes a pair of first differential signal leads, a pair of second differential signal leads and a ground lead located between the pair of first differential signal leads and the pair of second differential signal leads. The second leads are disposed on the insulating base and soldered to the second surface. The second leads include a power lead, a second ground lead and a pair of third differential signal leads located between the power lead and the second ground lead.

An electric assembly including a circuit board and an electric connector is further provided. The circuit board comprises a first surface and a second surface opposite thereto. The electric connector includes a metallic case, an insulating base, a plurality of first leads and a plurality of second leads. The insulating base is connected with the metallic case. The first leads are disposed on the insulating base and soldered to the first surface. The first leads includes a pair of first differential signal leads, a pair of second differential signal leads and a ground lead located between the pair of first differential signal leads and the pair of second differential signal leads. The second leads are disposed on the insulating base and soldered to the second surface. The second leads include a power lead, a second ground lead and a pair of third differential signal leads located between the power lead and the second ground lead.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention.

DESCRIPTION OF EMBODIMENTS

The electric assembly and the electric connector of the present invention are suitable for USB 3.0 provided with five additional leads in the electric connector as compared with a conventional electric connector of USB 2.0, wherein four leads are used as a transmitting differential signal pair and a receiving differential signal pair, and the fifth lead is used for grounding. It is noted that, in general, an USB electric connector disposed on a device is also named a plug connector, while an USB electric connector disposed on a host is further named a receptacle connector. The electric connector of the present invention is illustrated below.

Figure 1:
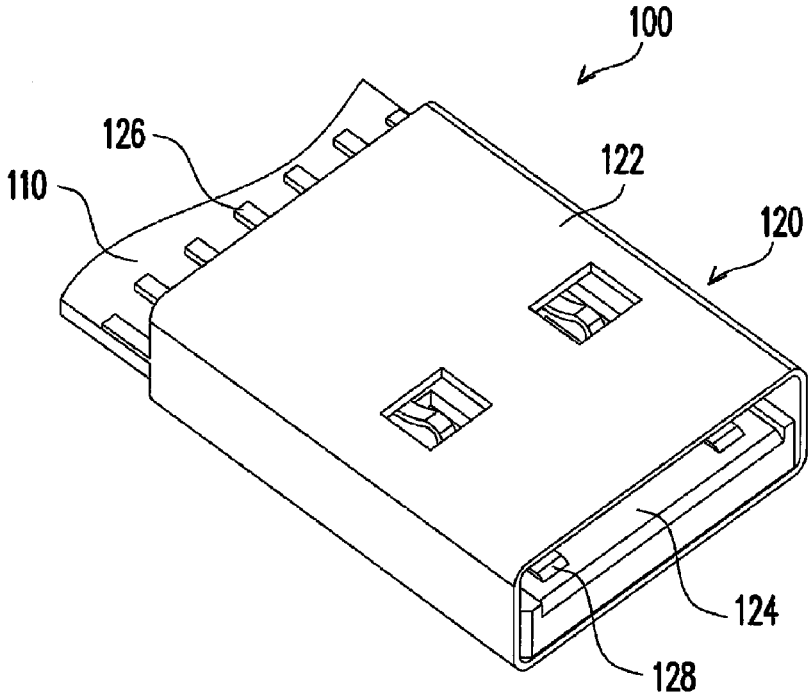
FIG. 1 is a schematic view of an electric assembly including an electric connector according to one embodiment of the present invention.
Figure 2:
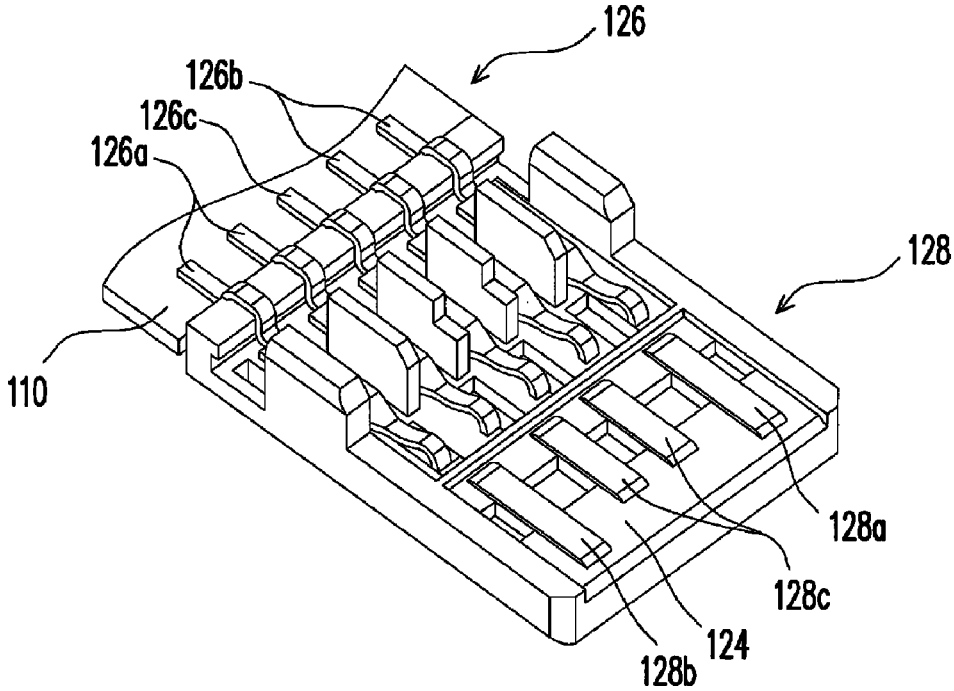
FIG. 2 is a perspective view of a part of components of the electric assembly in FIG. 1.

FIG. 1 is a schematic view of an electric assembly including an electric connector according to one embodiment of the present invention. FIG. 2 is a perspective view of a part of components of the electric assembly in FIG. 1. Referring to FIG. 1 and FIG. 2, the electric assembly 100 includes a circuit board 110 (only a part of the circuit board 110 is shown) and an electric connector 120, wherein the electric connector 120 may be disposed on a device and named a plug connector. The electric connector 120 includes a metallic case 122, an insulating base 124 connected with the metallic case 122, a plurality of first leads 126 and second leads 128 disposed on the insulating base 124.

The first leads 126 includes a pair of first differential signal leads 126*a*, a pair of second differential signal leads 126*b* and a ground lead 126*c* located between the pair of first differential signal leads 126*a* and the pair of second differential signal leads 126*b*. The second leads 128 include a power lead 128*a*, a second ground lead 128*b* and a pair of third differential signal leads 128*c* located between the power lead 128*a* and the second ground lead 128*b*.

In this embodiment, the pair of first differential signal leads 126*a* is a pair of transmitting differential signal leads $T_x^+$ and $T_x^-$ for USB 3.0, while the pair of second differential signal leads 126*b* a pair of receiving differential signal leads $R_x^+$ and $R_x^-$ for USB 3.0. Furthermore, the pair of third differential signal leads 128*c* is a pair of transmitting/receiving differential signal leads $D^+$ and $D^-$ for USB 3.0 and supporting USB 1.0 or USB 2.0.

Figure 3:
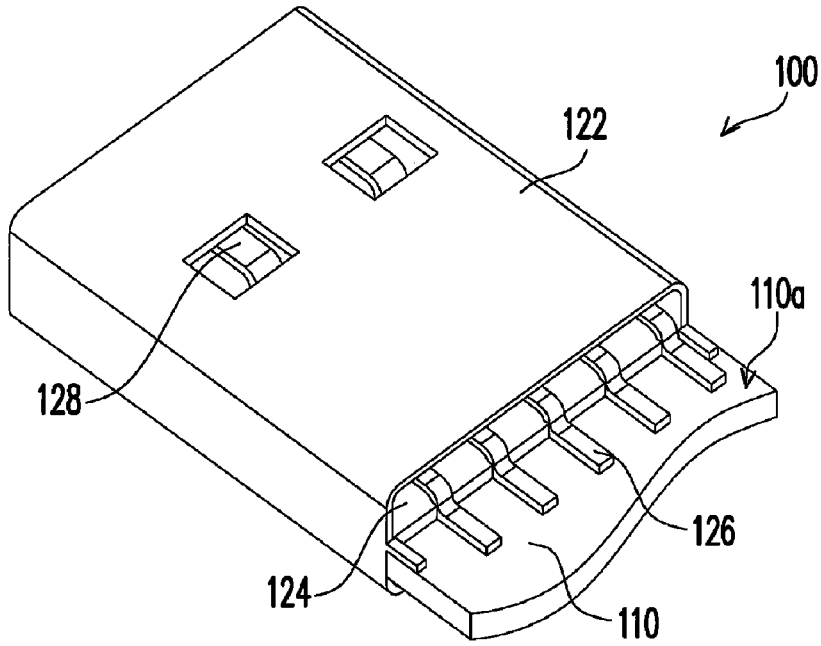
FIG. 3 is another perspective view of the electric assembly in FIG. 1.
Figure 4:
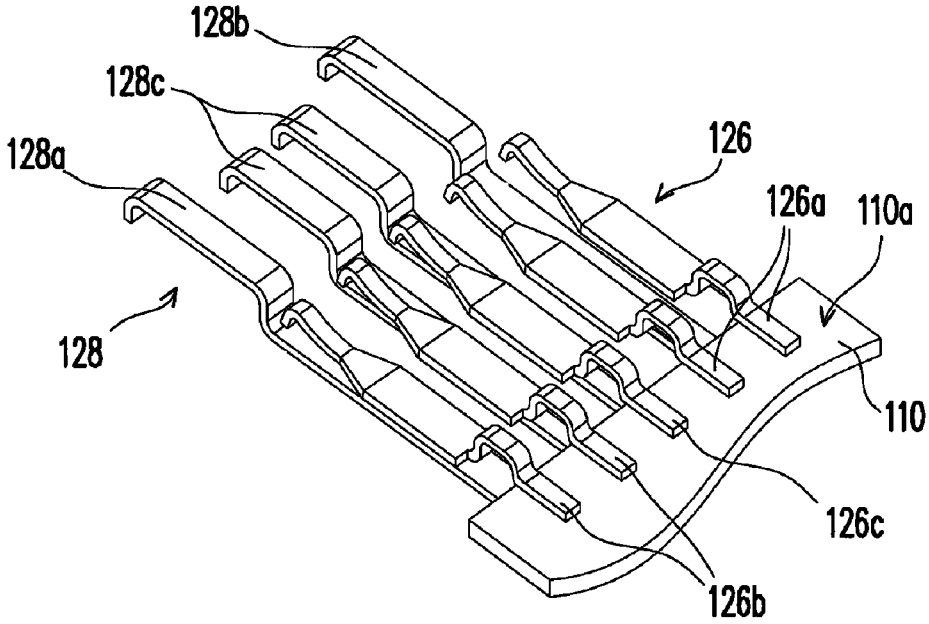
FIG. 4 is a perspective view of a part of components of the electric assembly in FIG. 3.
Figure 5:
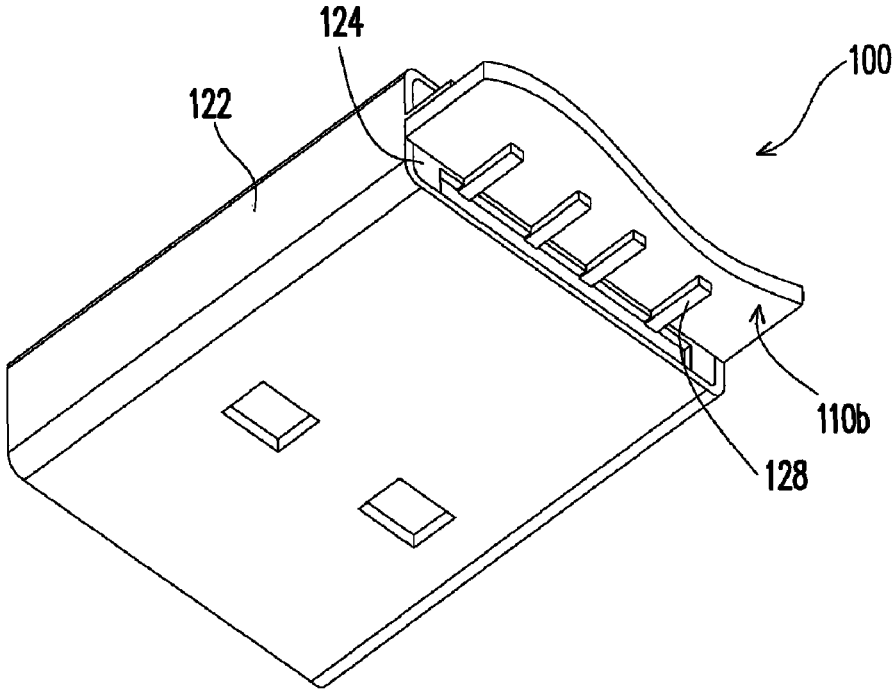
FIG. 5 is further another perspective view of the electric assembly in FIG. 1.
Figure 6:
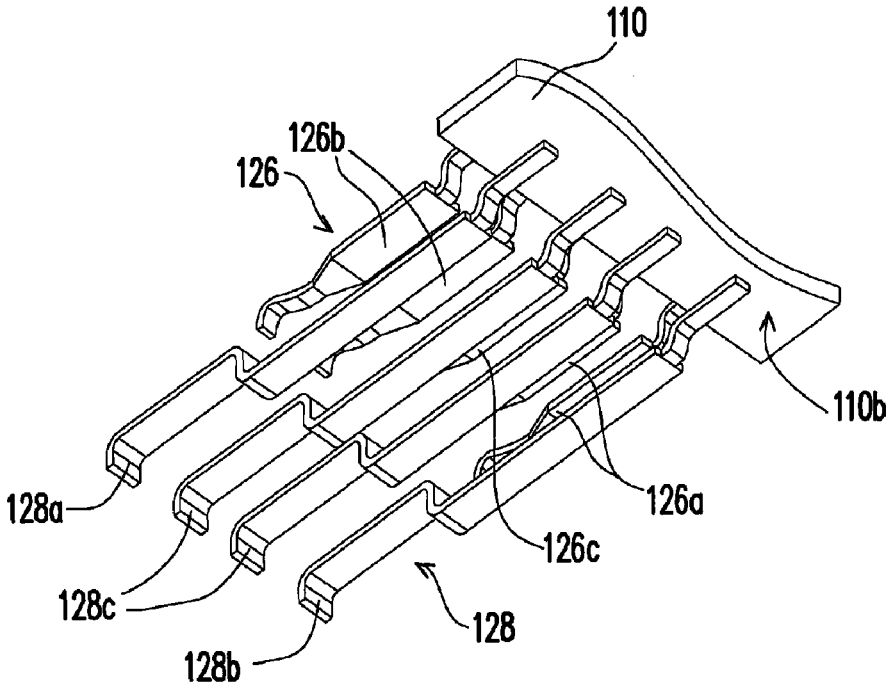
FIG. 6 is a perspective view of a part of components of the electric assembly in FIG. 5.

FIG. 3 is another perspective view of the electric assembly in FIG. 1. FIG. 4 is a perspective view of a part of components of the electric assembly in FIG. 3. FIG. 5 is further another perspective view of the electric assembly in FIG. 1. FIG. 6 is a perspective view of a part of components of the electric assembly in FIG. 5. Referring to FIGS. 3-6, the circuit board 110 has a first surface 110*a* as shown in FIGS. 3 and 4 and a second surface 110*b* as shown in FIGS. 5 and 6. The first leads 126 are soldered to the first surface 110*a* of the circuit board 110, while the second leads 128 are soldered to the second surface 110*b* of the circuit board 110.

Figure 7:
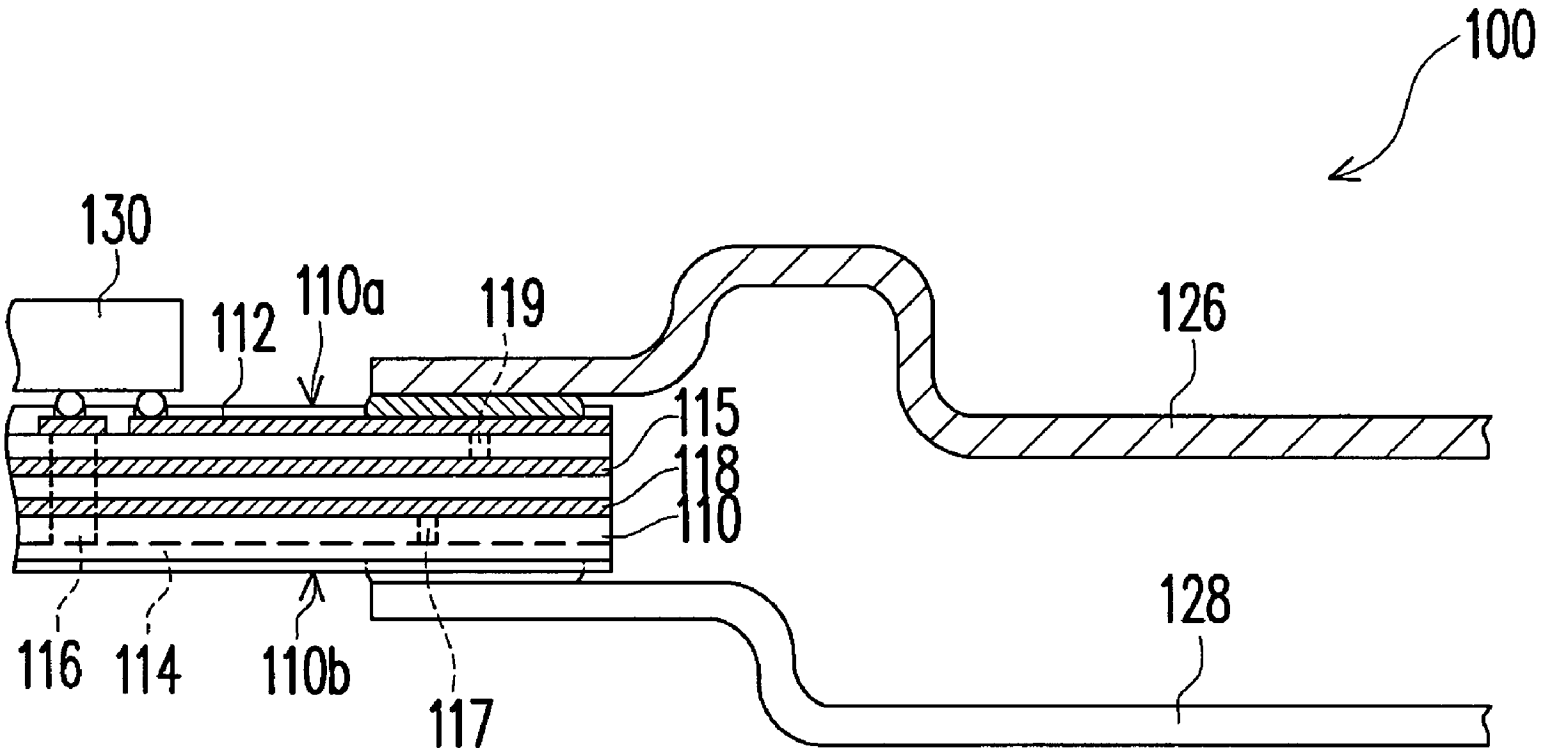
FIG. 7 is a cross-sectional view of a part of components of the electric assembly in FIG. 1.

FIG. 7 is a cross-sectional view of a part of components of the electric assembly in FIG. 1. Referring to FIG. 7, in this embodiment, the electric assembly 100 further comprises a control chip 130 mounted to the first surface 110*a*, wherein the control chip 130 may be used for controlling the access of a memory such as NAND Flash (not shown). In addition, the circuit board 110 includes a first circuit 112 disposed on the first surface 110*a* and a second circuit 114 disposed on the second surface 110*b*. In this embodiment, the first circuit 112 and the second circuit 114 are located on different cross-sections, and thus the second circuit 114 is shown in dashed line in FIG. 7. The control chip 130 is soldered to the first circuit 112. The first leads 126 are soldered to the first circuit 112 and electrically connected to the control chip 130 through the first circuit 112. The second leads 128 are soldered to the second circuit 114 and electrically connected to the control chip 130 through the second circuit 114.

In this embodiment, the circuit board 110 further comprises a plurality of conductive vias 116 for connecting the second circuit 114 to the first circuit 112. Therefore, the second leads 128 are electrically connected to the control chip 130 through the second circuit 114, the conductive vias 116 and the first circuit 112 sequentially.

It is noted that since the first circuit 112 connected with the first leads 126 and the second circuit 114 connected with the second leads 128 are respectively disposed on the first surface 112 and the second surface 114 of the circuit board 110, a large spacing between the first circuit 112 and the second circuit 114 is obtained for reducing unwanted crosstalk of signal. Furthermore, the first surface 110*a* of the circuit substrate 110 is preserved for the first leads 126 exclusively, wherein the spacing between the first differential signal leads 126*a* and the second differential signal leads 126*b* as shown in FIG. 4 is large so as to reduce coupling between the first differential signal leads 126*a* and the second differential signal leads 126*b*, and the performance of signal transmission is thereby improved.

Figure 8:
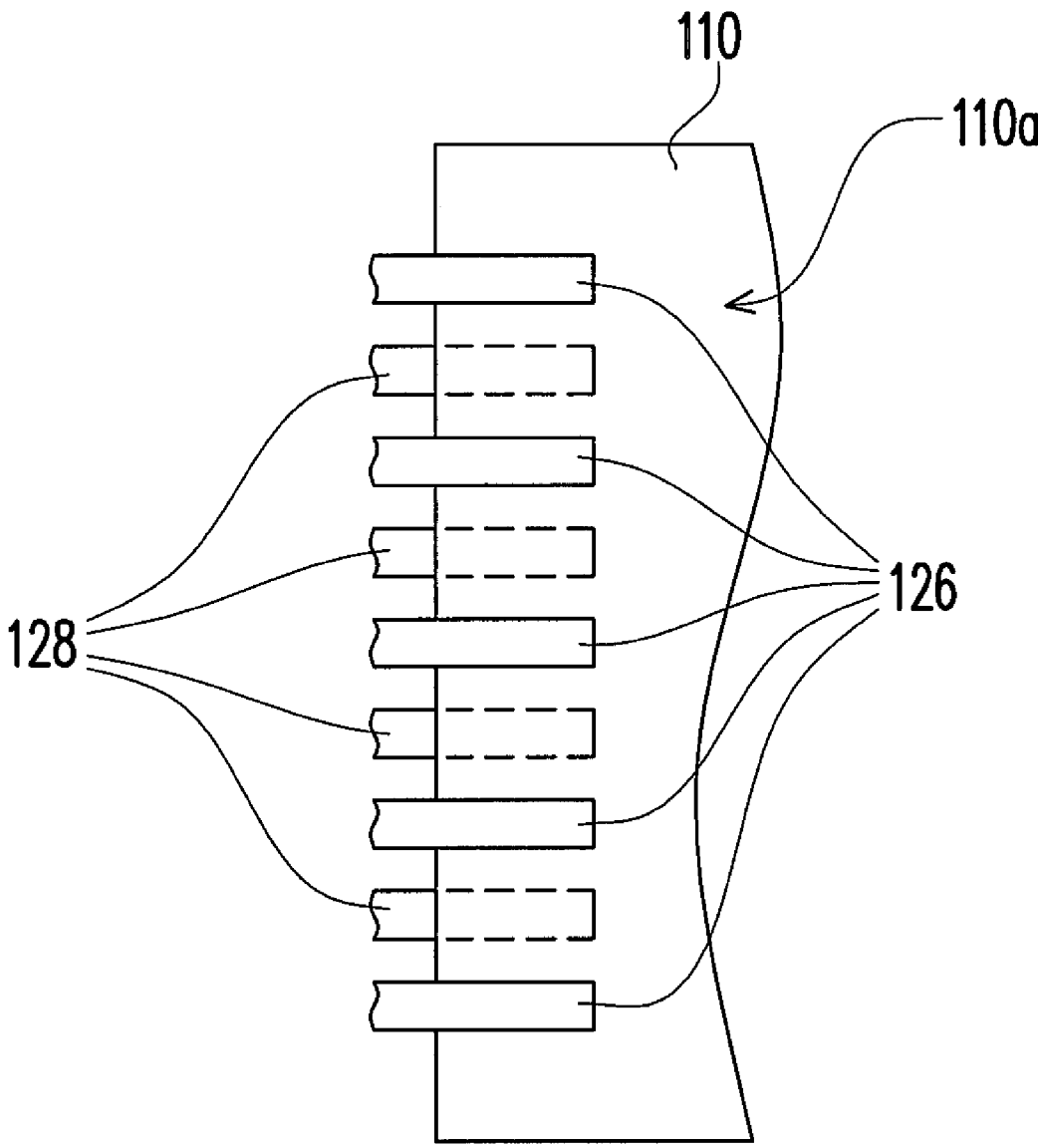
FIG. 8 is a partial top view of a part of the electric assembly in FIG. 4.

FIG. 8 is a partial top view of a part of the electric assembly in FIG. 1. Referring to FIG. 8, an orthographic projection of the first leads 126 on the first surface 110*a* does not overlap an orthographic projection of the second leads 128 on the first surface 110*a*. In other words, the first leads 126 and the second leads 128 are arranged on the circuit board 110 in a stagger. It should be noted that the above embodiment in FIG. 8 is not intended to limit the present invention. In other embodiment, the orthographic projection of the first leads 126 on the first surface 110*a* may partially overlap the orthographic projection of the second leads 128 on the first surface 110*a* (not shown).

Referring to FIG. 7, the circuit board 110 of this embodiment further comprises two reference planes 118 and 115. The reference planes 118 and 115 are located between the first circuit 112 and the second circuit 114, for providing a shielding effect to reduce the crosstalk of signal between the first circuit 112 and the second circuit 114. In this embodiment, the reference plane 118 may be a ground plane, while the reference plane 115 may be a power plane. In another embodiment, the reference plane 118 may be a power plane, while the reference plane 115 may be a ground plane. The first ground lead 126*c* and the second ground lead 128*b* as shown in FIG. 2 are electrically connected to the reference plane 118 through the conductive vias 117 as shown in FIG. 7, while the power lead 128*a* as shown in FIG. 2 is electrically connected to the reference plane 115 through the conductive via 119. In another embodiment, the power lead 128*a* may be electrically connected to other devices relevant to the power.

In summary, the first leads and the second leads are respectively disposed on two opposite surfaces (i.e. the first surface and the second surface) of the circuit board, and thus a large spacing between the first circuit on the first surface for connecting the first leads and the second circuit on the second surface for connecting the second leads is enlarged for reducing unwanted crosstalk of signal between the first circuit and the second circuit. Furthermore, the first surface of the circuit substrate is preserved for the first leads exclusively, wherein the spacing between the first differential signal leads and the second differential signal leads are sufficient for reducing coupling between the first differential signal leads and the second differential signal leads, and thereby the performance of signal transmission is improved. Additionally, the reference plane can be provided between the first circuit and the second circuit so as to provide a shielding effect and reduce the crosstalk of signal between the first circuit and the second circuit.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An electric connector suitable for being mounted on a circuit board, the circuit board having a first surface and a second surface opposite to the first surface, and the circuit board comprising a first circuit disposed on the first surface and a second circuit disposed on the second surface, the electric connector comprising:

a metallic case;

an insulating base connected with the metallic case;

a plurality of first leads disposed on the insulating base and soldered to the first surface, wherein the first leads comprises:

a pair of first differential signal leads;

a pair of second differential signal leads; and a first ground lead located between the pair of first differential signal leads and the pair of second differential signal leads, wherein the pair of first differential signal leads and the pair of second differential signal leads of the first leads are soldered to the first circuit; and a plurality of second leads disposed on the insulating base and soldered to the second surface, wherein the second leads comprises:

a power lead;

a second ground lead; and a pair of third differential signal leads located between the power lead and the second ground lead, wherein the pair of third differential signal leads of the second leads are soldered to the second circuit.

2. The electric connector as claimed in claim 1, wherein the pair of first differential signal leads is a pair of transmitting differential signal leads $T_x^+$ and $T_x^-$ for USB 3.0, while the pair of second differential signal leads is a pair of receiving differential signal leads $R_x^+$ and $R_x^-$ for USB 3.0.

3. The electric connector as claimed in claim 1, wherein the pair of third differential signal leads is a pair of transmitting/receiving differential signal leads $D^+$ and $D^-$ for USB 3.0 and supporting USB 1.0 or USB 2.0.

4. The electric connector as claimed in claim 1, wherein an orthographic projection of the first leads on the first surface does not overlap an orthographic projection of the second leads on the first surface.

5. An electric assembly, comprising:

a circuit board having a first surface and a second surface opposite to the first surface, the circuit board comprises:

a first circuit disposed on the first surface; and a second circuit disposed on the second surface; and an electric connector, comprising:

a metallic case;

an insulating base connected with the metallic case;

a plurality of first leads disposed on the insulating base and soldered to the first surface, wherein the first leads comprises:

a pair of first differential signal leads;

a pair of second differential signal leads;

a first ground lead located between the pair of first differential signal leads and the pair of second differential signal leads, wherein the pair of first differential signal leads and the pair of second differential signal leads of the first leads are soldered to the first circuit;

a plurality of second leads disposed on the insulating base and soldered to the second surface, wherein the second leads comprises:

a power lead;

a second ground lead; and a pair of third differential signal leads located between the power lead and the second ground lead, wherein the pair of third differential signal leads of the second leads are soldered to the second circuit.

6. The electric assembly as claimed in claim 5, wherein the pair of first differential signal leads is a pair of transmitting differential signal leads $T_x^+$ and $T_x^-$ for USB 3.0, while the pair of second differential signal leads is a pair of receiving differential signal leads $R_x^+$ and $R_x^-$ for USB 3.0.

7. The electric assembly as claimed in claim 5, wherein the pair of third differential signal leads is a pair of transmitting/receiving differential signal leads $D^+$ and $D^-$ for USB 3.0 and supporting USB 1.0 or USB 2.0.

8. The electric assembly as claimed in claim 5, wherein an orthographic projection of the first leads on the first surface does not overlap an orthographic projection of the second leads on the first surface.

9. The electric assembly as claimed in claim 5, further comprising:

a control chip disposed on the first surface.

10. The electric assembly as claimed in claim 9, wherein the pair of second differential signal leads of the first leads are electrically connected to the control chip via the first circuit, and the pair of third differential signal leads of the second leads are electrically connected to the control chip via the second circuit.

11. The electric assembly as claimed in claim 10, wherein the circuit board further comprises:

a plurality of conductive vias connecting the second circuit to the first circuit such that the second leads are electrically connected to the control chip through the second circuit, the conductive vias and the first circuit sequentially.

12. The electric assembly as claimed in claim 10, wherein the circuit board further comprises:

a reference plane located between the first circuit and the second circuit.

13. The electric assembly as claimed in claim 12, wherein the reference plane is a ground plane, and both of the ground lead and the second ground lead are electrically connected to the ground plane.

14. The electric assembly as claimed in claim 12, wherein the reference plane is a power plane, and the power lead is electrically connected to the power plane.

* * * * *